US005472212A

United States Patent [19]

Bercaw

[11] Patent Number: 5,472,212

[45] Date of Patent: Dec. 5, 1995

[54] AUXILIARY PRACTICE NET APPARATUS FOR ATTACHING TO A VOLLEYBALL NET

[76] Inventor: Robert H. Bercaw, 20301 Bluffside Cir., #114, Huntington Beach, Calif. 92646

[21] Appl. No.: 177,179

[22] Filed: Jan. 4, 1994

[51] Int. Cl.[6] ..... A63B 61/00

[52] U.S. Cl. ..... 273/441; 273/29 R

[58] Field of Search ..... 273/29 B, 29 BB, 273/411, 29 A, 55 B, 30, 29 R

[56] References Cited

U.S. PATENT DOCUMENTS

| | | | |
|---|---|---|---|
| 3,215,432 | 11/1965 | Lee et al. | 273/29 A |
| 3,563,544 | 2/1971 | Hedrick | 273/29 A |
| 3,794,322 | 2/1974 | Rosekrans | 273/411 |
| 3,820,787 | 6/1974 | Heinbigner | 273/55 B |
| 3,860,240 | 1/1975 | Koch | 273/411 |
| 3,897,950 | 8/1975 | Keller | 273/411 |
| 3,940,139 | 2/1976 | Barnes . | |
| 3,966,205 | 6/1976 | Schain | 273/29 A |
| 4,022,471 | 5/1977 | Keller | 273/411 |
| 4,160,549 | 7/1979 | Simpson | 273/29 A |
| 4,696,471 | 9/1987 | McGrath | 273/29 B |
| 4,796,886 | 1/1989 | Loh | 273/29 A |
| 5,062,646 | 11/1991 | Crist . | |

FOREIGN PATENT DOCUMENTS

| | | | |
|---|---|---|---|
| 3339376 | 5/1985 | Germany | 273/411 |
| 24-1000 | of 0000 | Japan . | |

OTHER PUBLICATIONS

Volleyball One Catalog pp. 18–21.

Applicant's Initial Search w/patent list printout and copies of selected abstracts.

Post–Filing Computer Search dated Jan. 26, 1994.

*Primary Examiner*—Theatrice Brown

*Attorney, Agent, or Firm*—Howard R. Lambert

[57] ABSTRACT

An auxiliary net apparatus for practicing volleyball serves and spikes is configured for attaching to a conventional volleyball net. The apparatus comprises a flexible, quadrilateral practice net, first and second, elongate, stiff side members removably disposed along opposite side edge regions of the practice net, and net attachers associated with the side members for detachably attaching the members, and thus the practice net, to an upper edge of a volleyball net with the auxiliary net apparatus supported solely by the volleyball net, and with the upper edge of the practice net located at a distance about equal to the top-to-bottom height of the volleyball net above the upper edge of the volleyball net and with the lower edge of the practice net at or below the bottom edge of the volleyball net. The width of the practice net is preferably less than the stretched width of a conventional volleyball net and its height is about twice the top-to-bottom height of the volleyball net. The apparatus further includes flexible strips or ties for releasably attaching lower regions of the practice net to the lower edge regions of the volleyball net. The practice net has an elastic cord attached along its lower edge to substantially reduce the effective length of the lower edge so as to retain a spiked volleyball between the practice net and the volleyball net to which the practice net is attached.

19 Claims, 3 Drawing Sheets

FIG. 3a.
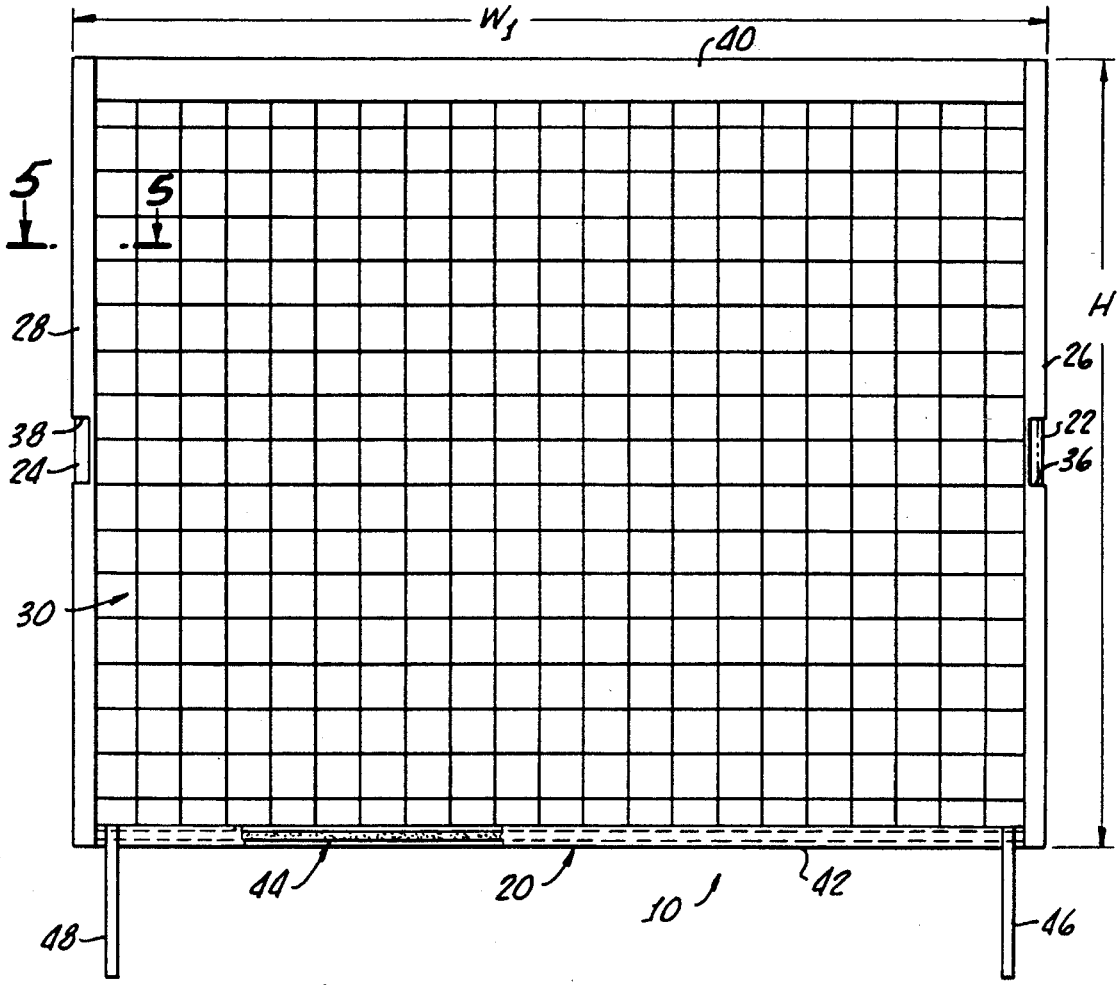
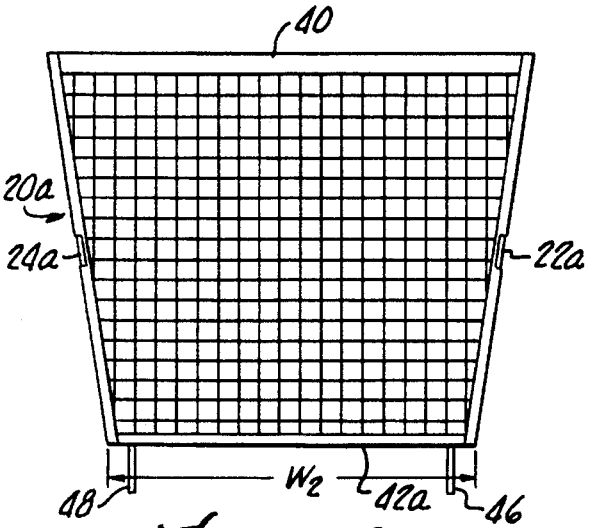
FIG. 3b.
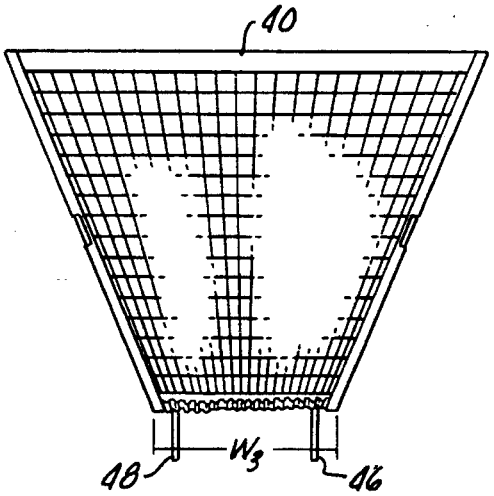
FIG. 4.

FIG. 6.
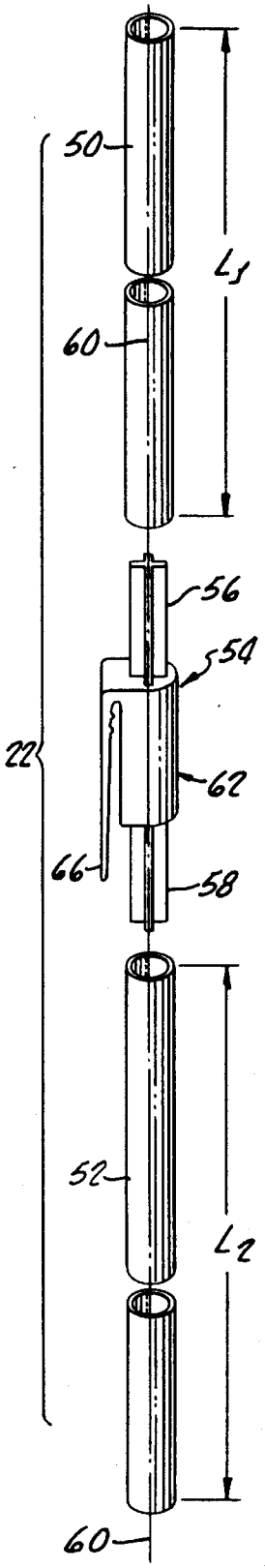
FIG. 7.
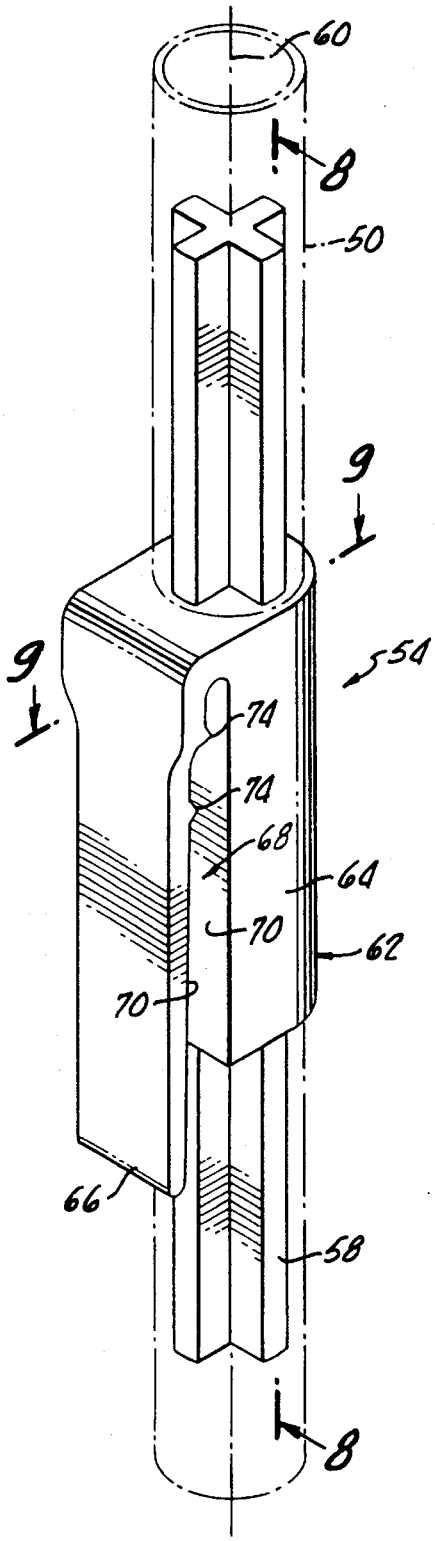
FIG. 8.
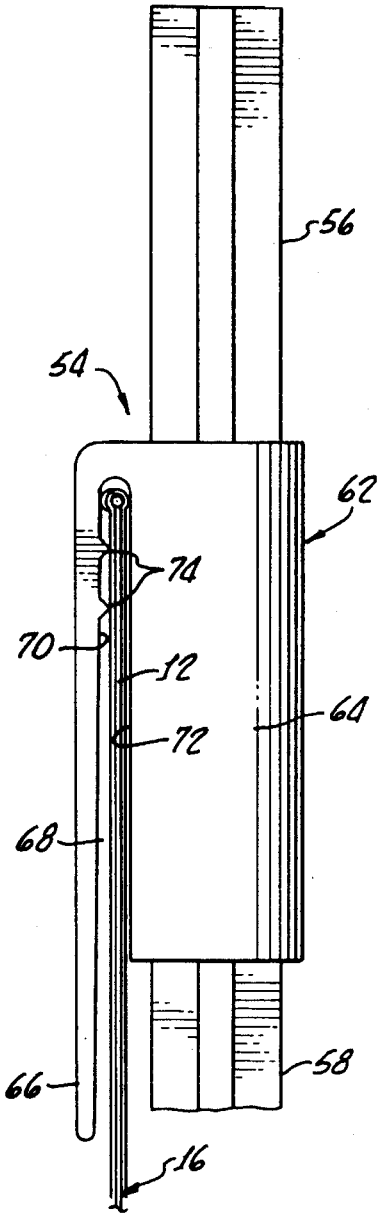
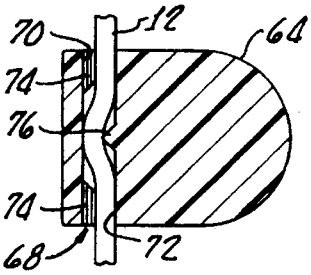
FIG. 9.

AUXILIARY PRACTICE NET APPARATUS FOR ATTACHING TO A VOLLEYBALL NET

BACKGROUND OF THE INVENTION

1. Field of the Invention

The present invention relates generally to the field of sports, more particularly to volleyball, and still more particularly to practice nets for practicing the serving and spiking of volleyballs.

2. Background Discussion

From its origin years ago by the YMCA as an indoor recreational sport, volleyball has become a serious, internationally-recognized, highly competitive sport. Although volleyball is still a popular recreational game played in gymnasiums, parks and beaches—only a net and ball are required, only a relatively small play area is needed, and it is a game most people can play—amateur tournaments are common, for example, between company, community, church, high school and college teams. Moreover, indoor, six-person volleyball is presently an Olympic sport and two-person, sand volleyball is scheduled to become an Olympic sport in the 1996 Olympics.

Volleyball is a relatively simple sport, and as is well known, is played by two teams—one on each side of a net similar to a tennis net. One player on one team serves the ball over the net to the other team, which tries to return the ball without letting it touch the ground. In returning the ball, the returning team typically bumps the ball from one player to another while keeping the ball in the air and inside the boundary of the "court" while setting up the ball for a return shot which it is hoped that the serving team will miss. The volleying continues until the ball hits the ground on one side or the other.

As is the case for many so-called "simple" sports, a great amount of skill is required for an individual to become a good, competitive volleyball player. Consequently, many volleyball players who take volleyball seriously spend a considerable amount of time and energy practicing the game and certain important, difficult to master, aspects of the game.

In this regard, one of the most important and probably the most difficult of the maneuvers or tactics in volleyball is popularly called the "spike." In the spike maneuver, the volleyball is bumped to a player on the same team who is close to the net. The receiving player then attempts to slam the ball downwardly so quickly on the other side of the net that no player on the other team can get to the ball to return it, a point being thereby given to the team that successfully spiked the ball if that team served the ball.

As easy as spiking sounds, it is, as mentioned above, a difficult maneuver to complete successfully. For example, if the player's timing or aim is off, he or she may spike the ball on his or her side of the net instead of on the other side of the net, thereby giving the other team a point or losing the serve. Or, a poor spike by one team may set up the other team for a successful spike Another difficult maneuver, and one also requiring considerable practice to achieve a good technique is serving the volleyball. A good volleyball serve is, for example, one that is placed where the server intends and from which a successful return is difficult and hopefully impossible. Good serving technique requires a keen eye, power and precise control—attributes that are difficult to achieve without considerable practice. An example of a bad volleyball serve would, of course, be one that enables the receiving team to successfully spike the ball to the serving team.

In some respects practicing volleyball spikes and/or serves is like baseball batting practice without a fielder—a lot of energy and practice time is spent chasing and retrieving the ball. Moreover, free-flying balls would tend to disrupt other games being played in the same general area. For this reason, a special spiking practice apparatus has been developed. U.S. Pat. No. 5,062,646 to Michael Crist, for example, discloses a volleyball net having wall-mounted frames which support both the volleyball net and a "no rebound ball barrier" mounted rearwardly of the net, the barrier being constructed to catch and return volleyballs struck over the net.

The volleyball apparatus disclosed in the Crist patent thus appears limited to the practicing of volleyball spikes and possibly other volleyball maneuvers by school teams or players inside of high-school or college gymnasiums, and does not appear to be practical for spiking practice by the large number of teams or players who play and/or practice volleyball outdoors at the beach, in parks or in other recreational areas. In fact, in most outdoors volleyball playing areas, there would be no satisfactory place to set up the apparatus disclosed in the Crist patent and even if there were places, the cost of the disclosed apparatus would be prohibitive for most volleyball players. Moreover, the disclosed apparatus does not appear to be readily portable or easily set up and knocked down.

For these and other reasons, the present inventor has invented an inexpensive, easily portable apparatus for practicing volleyball spikes and serves which is constructed to be quickly and easily attached to any volleyball net, either indoors or outdoors, and which requires no installation tools and which can be easily taken down and easily carried by one person, and which can be easily carried in any automobile or even on a bicycle or in public transportation.

SUMMARY OF THE INVENTION

In accordance with the present invention there is provided an auxiliary net apparatus for practicing volleyball spikes and/or serves and which can be detachably attached to a conventional volleyball net. In a broad sense, the apparatus comprises a flexible barrier for intercepting volleyballs and means for detachably attaching the barrier to a conventional installed volleyball net so that the barrier is supported solely by the volleyball net. Preferably, side edge regions of the barrier are detachably attached to upper edge regions of the volleyball net and lower regions of the barrier are detachably attached to lower edge regions of the volleyball net.

In accordance with a preferred embodiment of the invention, the barrier comprises a net apparatus which is formed of a flexible practice net having an upper edge, a lower edge and first and second, opposite side edges and having a height substantially greater than the height of a stretched volleyball net.

Included in the apparatus are first and second, elongate, stiff side members which are disposed along respective ones of the first and second side edge regions of the practice net, and net attachers which form part of the first and second members for detachably attaching the members, and thus the practice net, to at least an upper edge region of the volleyball net with the auxiliary net apparatus supported solely by the volleyball net and with the upper edge of the practice net positioned a predetermined distance above the upper edge of the volleyball net and with the lower edge of the practice net below the upper edge of the volleyball net.

Preferably, each of the first and second side members is removable from the practice net and is also, for convenience in storing and carrying the apparatus, constructed of at least two longitudinal segments. In which case, the net attachers are constructed for detachably connecting the at least two longitudinal segments together in a linear manner.

It is also preferred that the practice net, which may be formed having the same mesh size as a conventional volleyball net, is quadrilateral in shape and is preferably rectangular in shape with its width being substantially less than the stretched width of a conventional volleyball net and its height being substantially greater than the height of the stretched volleyball net.

In further accordance with a preferred embodiment of the invention, there are included in the apparatus means for gathering the bottom edge of the practice net so as to retain within the confines of the practice net a volleyball spiked or served into the practice net when the practice net is attached to a volleyball net. To this end, the bottom edge of the practice net is preferably formed with a flexible tubular strip, the gathering means then including an elastic cord or a drawstring disposed through the tubular strip.

Preferably, the predetermined distance of the upper edge of the practice net above the upper edge of said volleyball net is about equal to the height of the volleyball net to which the practice net is attached. Also preferably, there are included means for releasably attaching lower regions of the practice net to a bottom edge region of the volleyball net The auxiliary net apparatus can thus be easily attached by a single individual to a conventional volleyball net anywhere—either indoors or outdoors—the volleyball net can be set up for playing volleyball and does not require a dedicated practice area or court. Since the apparatus is supported solely by the stretched volleyball net, it does not require any additional stays or supports and is thus easy to install and take down.

After the apparatus is detached from the volleyball net, the side members can be easily removed from the practice net and the segments of the side members can be disassembled so that the practice net and disassembled side members can be easily carried and stowed, for example, in the trunk of an automobile.

The apparatus of the invention is relatively inexpensive to manufacture and can thus be afforded by most individual volleyball players.

BRIEF DESCRIPTION OF THE DRAWINGS

The present invention can be more readily understood by a consideration of the following detailed description when taken in conjunction with the accompanying drawings, in which:

FIG. 3 is a plan view of two versions of the spike ball practice net apparatus showing the construction thereof, FIG. 3*a* showing a rectangular version of the practice net apparatus and FIG. 3*b* showing a trapezoidal version of the practice net apparatus;

FIG. 4 is a plan view of the spike ball practice net apparatus of FIG. 3 showing the bottom edge of the net gathered so as to reduce its bottom width;

FIG. 6 is an exploded perspective drawing showing the take-down construction of a representative one of the side support assemblies and showing a volleyball net clamp member that interconnects two tubular portions of the side support assembly and that is used to detachably clamp the spike ball practice net apparatus to an upper edge region of a conventional volleyball net;

FIG. 7 is an enlarged perspective drawing of the net clamp member depicted in FIG. 6;

FIG. 8 is a vertical cross sectional drawing taken along line 8—8 of FIG. 7 showing the manner in which the net clamp member clamps the side support assembly of the spike ball practice net apparatus to an upper edge strip of a conventional volleyball net; and FIG. 9 is a transverse cross sectional drawing taken along line 9—9 of FIG. 7 showing the clamping action of the clamp member against the upper edge strip of a conventional volleyball net.

In the various FIGS. identical elements and features are given the same reference number.

DETAILED DESCRIPTION OF THE INVENTION

Figure 1:
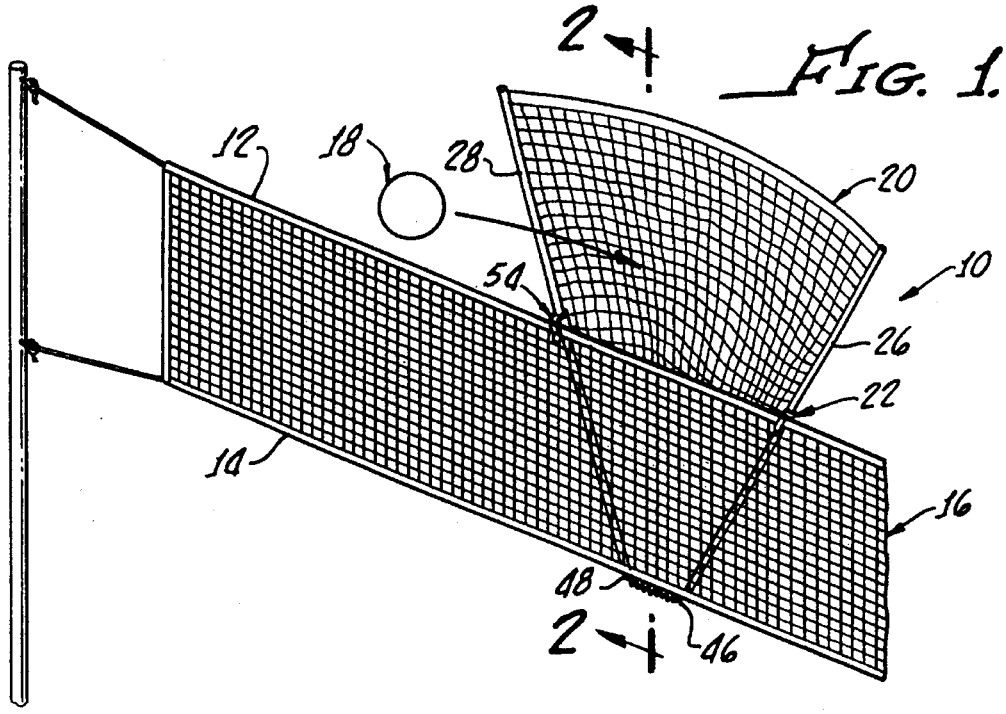
FIG. 1 is a perspective drawing showing an auxiliary volleyball practice net apparatus in accordance with the present invention attached to an installed, conventional volleyball net, only part of which is shown, the practice net apparatus shown as extending a substantial distance above the upper edge of the volleyball net to which it is attached in a location to intercept a spiked or served volleyball.

In FIG. 1, an auxiliary volleyball practice net or barrier apparatus 10, in accordance with the present invention, is shown detachably attached to upper and lower edge strips 12 and 14, respectively, of a conventional volleyball net 16 in a positron to intercept (i.e., catch) a spiked or served volleyball 18. Volleyball net 16, which is shown set-up in a usual manner, forms no part of the present invention and requires no modification or rework for enabling the attachment of practice net apparatus 10 thereto.

Generally comprising auxiliary volleyball practice net apparatus 10 are a practice net or barrier assembly 20 and respective first and second side edge support member assemblies 22 and 24, which are installed in corresponding first and second side edge sleeves 26 and 28 of the practice net assembly. As more particularly described below, side edge support member assemblies 22 and 24 are constructed to keep side edges of practice net assembly 20 taut and also to attach side edges of the practice net assembly to upper strip 12 of conventional or regulation volleyball net 16.

As best shown in FIG. 3*a*, practice net assembly 20, in accordance with one embodiment of the present invention, comprises a rectangular flexible net 30 having sewn or otherwise secured thereto along side edges thereof side edge sleeves 26 and 28 which are sized to accept respective side edge support members assemblies 22 and 24. Longitudinally central regions 36 and 38 of side edge sleeves 26 and 28 are cut out to enable in situ assembly and disassembly of side edge support member assemblies 22 and 24 for setup and take-down of practice net apparatus 10. An upper edge of practice net assembly 20 is finished with a fabric strip or tape 40 in the manner of regulation volleyball net 16.

Figure 2:
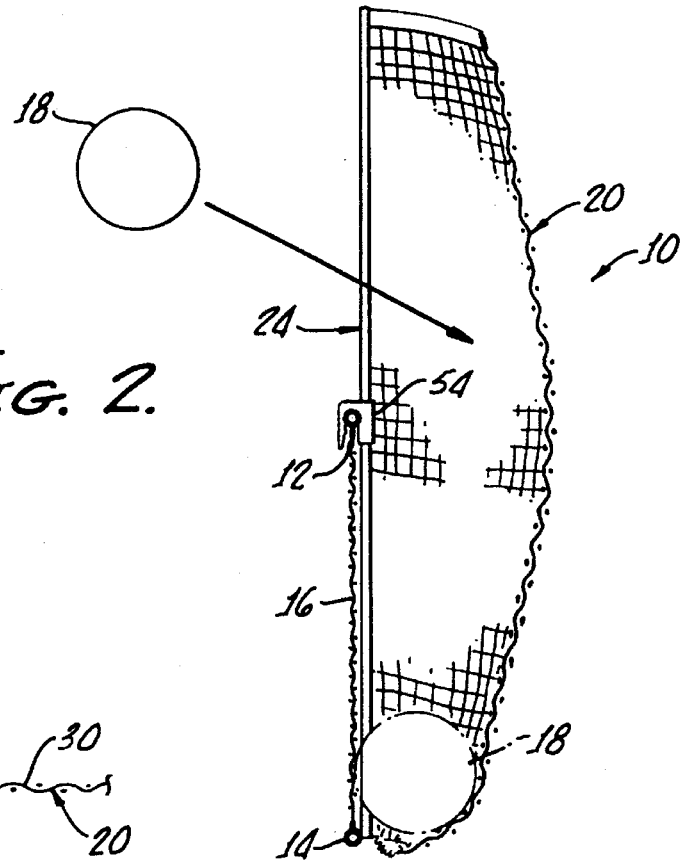
FIG. 2 is a vertical cross sectional drawing taken along line 2—2 of FIG. 1 showing features of the practice net apparatus and showing a volleyball spiked or served into the practice net apparatus, the volleyball being releasably retained between the practice net apparatus and the volleyball net to which the apparatus is attached.
Figure 5:
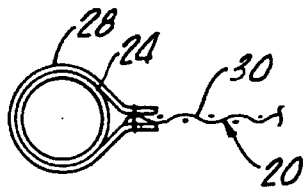
FIG. 5 is a transverse cross sectional drawing taken along line 5—5 of FIG. 3*a* showing a side support assembly of the practice net apparatus installed in a side edge sleeve of the net portion of the apparatus.

A lower edge of practice net assembly 20 is finished with a slender fabric sleeve 42 in or through which is installed net gathering means 44 for causing the lower edge of the net assembly to be shortened as depicted in FIGS. 1 and 4 to cause trapping of volleyball 18 spiked or served into apparatus 10 between the net assembly and volleyball net 16 (FIG. 2). Net gathering means 44 may, for example, comprise an elastic bungee cord or a length-adjustable drawstring of a type such as are commonly used in sports jackets and/or hoods thereof.

To enable releasable attaching of lower regions of practice net apparatus 10 to lower regions of volleyball net, first and second, elongate attachment strips 46 and 48, respectively, are attached to opposite lower corner regions of net assembly 20. Attachment strips 46 and 48 may, for example, comprise double-sided hook and loop fabric (with the hooks formed on one side and the loops formed on the other side) or may comprise simple lengths of cord.

As above-mentioned, net assembly 20 may be rectangular in outline having an overall, maximum side-to-side width, $W_1$, along tape 40 at the top of net 30 and an overall, top to bottom height, H. With no limitation being thereby intended or implied, width, $W_1$, may be about 70 inches, which is substantially less than the side-to-side width of a conventional volleyball net (which is about thirty feet) and height, H, may be about twice the height of volleyball net 16; that is, about 72 inches.

The mesh size of spike ball practice net 30 is preferably about the same as the mesh size of volleyball net 16, which is typically about 4 inches square, net 30 being preferably being made of the same material as volleyball net 16, which is ordinarily nylon.

A variation volleyball net assembly **20*a* is depicted in FIG. 3*b*. A principal difference between above-described practice net assembly 20 (FIG. 3*a*) and variation practice net 20*a* is that net assembly 20*a* is trapezoidal in shape instead of being rectangular. As such, practice net assembly 20*a* is constructed having a lower edge width, $W_2$, that for the above-mentioned top edge width, $W_1$, of about 70 inches may be about 60 inches. Although practice net 20*a* would thus require less net material than practice net assembly 20 and might therefore be expected to be less costly, some manufacturing costs are increased because of the trapezoidal shape of practice net assembly 20*a* and the requirement that side edge support member assemblies 22*a* and 24*a* are required to be somewhat longer than side member assemblies 22 and 24 because of the angled side edges of net assembly 20*a***.

For either of practice net assemblies 20 and **20*a*, the bottom edge width, $W_3$, is preferably set or adjusted (by gathering means 44) to be about 60 inches (FIG. 4**).

First and second side edge support member assemblies 22 and 24 are preferably identical in size, shape and construction, first side edge member assembly 22 being shown as representative of both in FIGS. 6 though 9, with no separate description of second member assembly 24 being needed.

Comprising side support member assembly 22 (shown in exploded perspective in FIG. 6) are respective upper and lower, elongate, straight, rigid or stiff tubular elements or segments 50 and 52 and a clip element 54 that serves the dual purposes of detachably interconnecting the two elements and detachably attaching side regions of practice net apparatus 10 to volleyball net 16 (FIG. 1).

As more particularly shown in FIG. 7, clip element 54 is formed having upper and lower spline regions 56 and 58, respectively, which are sized to fit tightly into ends of respective tubular elements 50 and 52 so as to interconnect the two tubular elements in series along a common longitudinal axis 60. Although spline regions 56 and 58 are depicted as being cruciform in transverse cross section it is to be appreciated any other spline configuration may be used.

Clip element 54 further includes a central clip region 62 having a barrel region 64 with an outwardly and downwardly extending tab or ear 66 which defines a relatively narrow vertical volleyball net-receiving gap 68 between opposing surfaces 70 and 72 of the tab and barrel region (FIGS. 7–9). A pair of vertically spaced apart transverse, V-shaped ribs 74 project inwardly from surface 70 toward opposing surface 72 of barrel region 64. A vertical, V-shaped rib 76 (FIG. 9) projects from barrel surface 72 toward ribs 74, which as indicated in FIG. 9, may be cutaway directly opposite to rib 76.

The function of ribs 74 and 76 is to grip upper strip 12 of volleyball net 16 relatively tightly so that when practice net apparatus 10 is installed on volleyball net 16 by clip elements 54 and strips 46 and 48, the apparatus stays in place without shifting sidewardly or vertically when volleyballs 18 are spiked or served with force into the practice net apparatus.

Tubular elements 50 and 52 are advantageously constructed from strong plastic pipe, made of such material as nylon, and preferably have an outside diameter of about ½ inch and an inside diameter of about ⅜ inch; each may be about 35 inches long (assuming a net height, H, of about 72 inches.

Clip elements 54 are preferably constructed from a hard plastic material, such as Nylon 6/6, and have an overall axial length (height) of a little over 3 inches.

For assembly of practice net apparatus 10, tubular elements 50 and 52 of both side support member assemblies 22 and 24 into their respective net side sleeves 26 and 28 (which are closed at the top and bottom ends) and are interconnected, through open regions 36 and 38, by clip elements 54 having spline regions 56 and 58 inserted in a tight-fitting relationship into adjacent ends of the tubular elements (as depicted in FIG. 7).

Practice net apparatus 10 is then easily and quickly clipped onto top strip 12 of volleyball net 16 by positioning exposed tabs 70 of clip elements 54 over such top strip and pulling downwardly until the clip elements are securely hooked onto the volleyball net. The bottom of practice net apparatus 10 is then attached to the bottom strip 14 of volleyball net 16 by strips 46 and 48. (FIG. 1). It is seen that by such an installation, practice net 20 extents a distance above upper strip 12 of volleyball net 16 about equal to the height of the volleyball net.

The attachment of practice net apparatus 10 to volleyball net 16 in the foregoing manner is seen not to require any other support and can be accomplished in a very short time by a single individual. Such installation of spike ball practice net apparatus 10 permits the apparatus to be easily installed at any desired side-to-side position on volleyball net 16 with any desired fan of practice net 20.

Detachment of practice net apparatus 10 from volleyball net 16 is accomplished in the reverse of its installation. Apparatus 10 is easily "knocked down" for carrying and storage by disassembling clip elements 54 from tubular elements 50 and 52.

Although there has been described and illustrated an auxiliary volleyball practice net apparatus for attaching to a conventional volleyball net for purposes of illustrating the manner in which the invention may be used to advantage, it is to be appreciated that the invention is not limited thereto. Therefore, any and all variations and modifications that may occur to those skilled in the applicable art are to be considered as being within the scope and spirit of the claims as appended hereto.

What is claimed is:

1. An auxiliary net apparatus for practicing volleyball spikes and serves and for attachment to a preexisting regulation volleyball net that is set up in a conventional manner, said net apparatus comprising:

a. a flexible auxiliary net having an upper edge, a lower edge and first and second, opposite side edges and having a height substantially greater than the height of said set-up volleyball net;

b. first and second, elongate, stiff side support members, said members being disposed along respective ones of said first and second side edge regions of said auxiliary net; and c. net attachment means on said first and second members, said net attachment mean being configured for enabling detachable attachment of said members and said practice net to an upper edge region of a conventional volleyball net with said auxiliary net apparatus supported solely by the volleyball net and with the upper edge of said auxiliary net positioned a predetermined distance above an upper edge of the volleyball net and with the lower edge of said auxiliary net below the upper edge of the volleyball net.

2. The auxiliary net apparatus as claimed in claim 1, wherein each of said first and second side members is removable from said auxiliary net.

3. The auxiliary net apparatus as claimed in claim 1, wherein each of said first and second side members is constructed of at least two longitudinal segments and including means for detachably connecting said at least two longitudinal segments together in a linear manner.

4. The auxiliary net apparatus as claimed in claim 1, wherein said auxiliary net is generally rectangular in shape.

5. The auxiliary net apparatus as claimed in claim 4, including means for gathering said bottom edge of said auxiliary net so as to retain within the confines of said practice net a volleyball spiked into the auxiliary net when the auxiliary net is attached to the volleyball net.

6. The auxiliary net apparatus as claimed in claim 5, wherein the gathering means include an elastic cord connected along said lower edge of said auxiliary net.

7. The auxiliary net apparatus as claimed in claim 5, wherein said bottom edge of the auxiliary net includes a flexible tubular strip and wherein said gathering means include a drawstring disposed through said tubular strip.

8. The auxiliary net apparatus as claimed in claim 1, said wherein predetermined distance is substantially equal to the height of the volleyball net.

9. The auxiliary net apparatus as claimed in claim 1, wherein the maximum side-to-side width of said auxiliary net is substantially less than the side-to-side width of the volleyball net.

10. The auxiliary net apparatus as claimed in claim 1, including means configured for enabling the releasable attachment of lower regions of said auxiliary net to a lower edge region of the volleyball net.

11. An auxiliary net apparatus for practicing volleyball serves and spikes and for attaching to a preexisting regulation volleyball net, that has been set up in a conventional manner, said auxiliary net apparatus comprising:

a. a flexible, generally quadrilateral net having an upper edge, a lower edge and first and second, opposite side edges and having a width substantially less than the stretched width of the volleyball net and a height substantially greater than the height of said stretched volleyball net, said auxiliary net being gathered along said bottom edge so as to reduce the length of said lower edge;

b. first and second, elongate, stiff side members, said members being removably attached along respective ones of said first and second side edges of said practice net;

c. net attachment means on said first and second members, said net attachment means being configured for removable attachment of said members and said auxiliary net to an upper edge region of the volleyball net, said auxiliary net being supported solely by the volleyball net with the upper edge of said auxiliary net positioned about the upper edge of the volleyball net and with the lower edge of said auxiliary net below the upper edge of the volleyball net; and d. means for removable attachment of a lower regions of said auxiliary net to lower edge regions of the volleyball net.

12. The auxiliary net apparatus as claimed in claim 11, wherein each of said first and second side members is constructed of at least two longitudinal segments and wherein said net attachment mean connect at least two longitudinal segments together in a linear manner.

13. The auxiliary net apparatus as claimed in claim 11, wherein said auxiliary net is generally rectangular in shape.

14. The auxiliary net apparatus as claimed in claim 11, wherein said auxiliary net includes an elastic cord connected along said lower edge of said auxiliary net for causing the gathering of said lower edge.

15. An auxiliary net apparatus for practicing volleyball serves and spikes and for attaching to a preexisting regulation volleyball net, said net apparatus comprising:

a. a flexible, quadrilateral auxiliary net having an upper edge, a lower edge and first and second, opposite side edges and having a maximum side-to-side width substantially less than the side-to-side width of the volleyball net and a height substantially greater than the height of the volleyball net, said auxiliary net having an elastic cord attached along said lower edge so as to substantially reduce the effective length of said lower edge when the elastic cord is in its unstretched condition;

b. first and second, elongate, stiff side members, said members being removably attached to respective ones of said first and second side edge regions of said auxiliary net;

c. net attachment means on said first and second members, said net attachment means being configured for removably attaching said members and said auxiliary net to an upper edge region of the volleyball net so that said auxiliary net is supported solely by the volleyball net with the upper edge of said auxiliary net positioned above an upper edge of the volleyball net and with the lower edge of said auxiliary net substantially at the bottom edge of the volleyball net; and d. means releasably attaching lower regions of said auxiliary net to a lower edge region of the volleyball net.

16. The auxiliary net apparatus as claimed in claim 15, wherein each of said first and second side members is constructed of at least two longitudinal segments and wherein said net attachment releasably connect said at least two longitudinal segments together in a linear manner.

17. The auxiliary net apparatus as claimed in claim 15, wherein the width and height of said auxiliary net are substantially equal.

18. The auxiliary net apparatus as claimed in claim 15, wherein the auxiliary net has a predetermined mesh size.

19. An auxiliary net apparatus for practicing volleyball serves and spikes, said apparatus comprising:

a flexible auxiliary net for intercepting volleyballs;

means for releasably attaching said auxiliary net to a regulation volleyball net that has been set up for game play, said auxiliary net being supported by the volleyball net only; said attachment means engaging the volleyball net such that side edge regions of said auxiliary net are attached to upper edge regions of the volleyball net and lower regions of said auxiliary net are attached to lower edge regions of the volleyball net.

* * * * *